United States Patent [19]

Elshoud

[11] Patent Number: 5,013,925

[45] Date of Patent: May 7, 1991

[54] COLLIMATING MARK DEVICE

[75] Inventor: Nicolaas P. Elshoud, Delft, Netherlands

[73] Assignee: B.V. Optische Industrie "De Oude Delft", Delft, Netherlands

[21] Appl. No.: 424,265

[22] PCT Filed: May 3, 1988

[86] PCT No.: PCT/EP88/00391

§ 371 Date: Oct. 23, 1989

§ 102(e) Date: Oct. 23, 1989

[87] PCT Pub. No.: WO88/08953

PCT Pub. Date: Nov. 17, 1988

[30] Foreign Application Priority Data

May 7, 1987 [NL] Netherlands ..... 8701074

[51] Int. Cl.[5] ..... G02B 23/00

[52] U.S. Cl. ..... 250/505.1; 33/241

[58] Field of Search ..... 250/505.1, 467.1; 356/153, 399; 33/241

[56] References Cited

U.S. PATENT DOCUMENTS 2,553,540 5/1951 Beckerman .
2,700,318 10/1951 Snyder .
3,684,383 8/1972 Johansson ..... 356/154
3,974,585 8/1976 Dunham ..... 33/241
4,383,474 5/1983 Paurus et al. ..... 89/41 ME
4,588,253 5/1986 Brunson ..... 350/1.1
4,832,451 5/1989 Trescott ..... 250/339
4,877,324 10/1989 Hauri et al. ..... 33/241

FOREIGN PATENT DOCUMENTS 2074754 11/1981 European Pat. Off. .
0173406 3/1986 United Kingdom .

*Primary Examiner*—Carolyn E. Fields
*Assistant Examiner*—Drew A. Dunn
*Attorney, Agent, or Firm*—Louis E. Marn

[57] ABSTRACT

A collimating mark device is provided with an infrared collimating mark intended to be observed through a sight. The infrared collimating mark is designed such that at least two V-shaped intensity distributions are positioned in a way that their respective apexes are facing one another. Despite a relatively blurred image after conversion into a visible collimating mark, the blurred visible collimating mark can be brought in a reproducible and reliable manner into coincidence with a fixed alignment mark.

21 Claims, 2 Drawing Sheets

FIG. 1
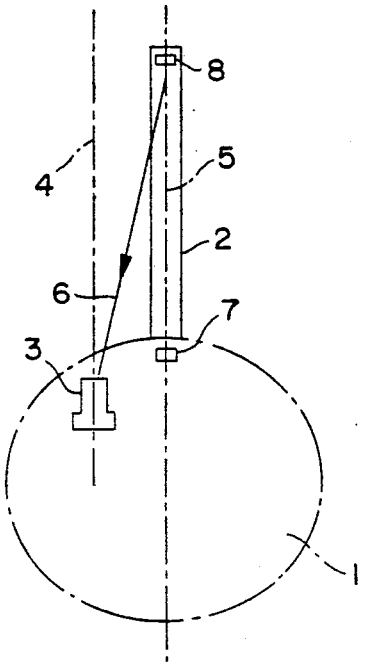
FIG. 2a
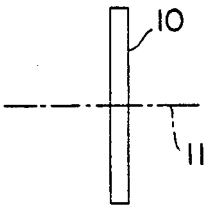
FIG. 2b
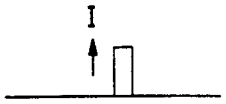
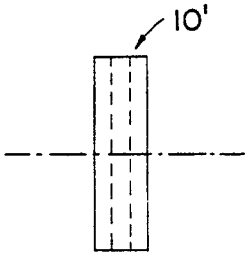
FIG. 2c
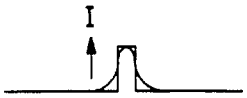
FIG. 2d
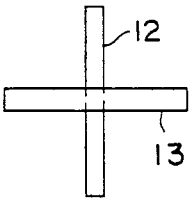
FIG. 3a
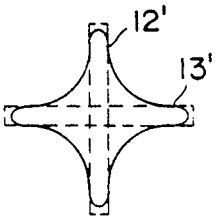
FIG. 3b
FIG. 4
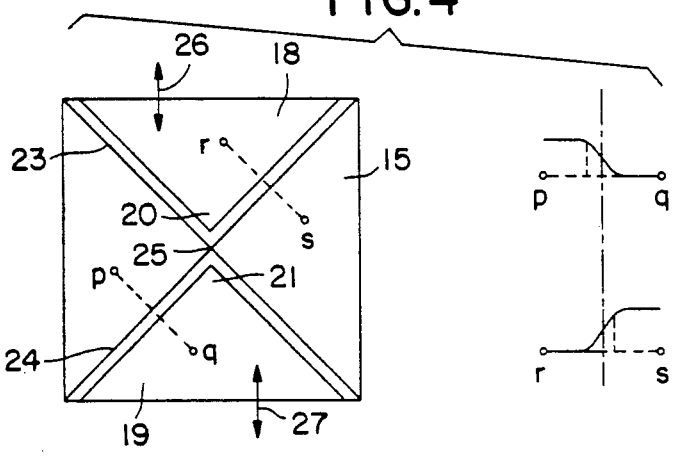
FIG. 5
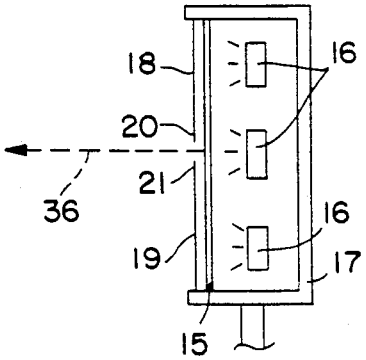

COLLIMATING MARK DEVICE

The invention relates to a collimating mark device provided with an infrared collimating mark intended to be observed through a sight.

It is known that the firing direction of a gun, that is to say the direction of the end of the firing barrel of the gun, and the viewing direction of a viewing sight are brought into coincidence with each other by reflecting an externally generated light image (collimating mark), for example a dot or a cross, via a mirror placed on the end of the firing barrel into the sight and bringing the image thus obtained in the site into coincidence with a fixed alignment mark.

Such a technique can be used in other situations in which the centre lines of two elements have to be adjusted to be parallel to or in line with each other. As an example, mention may be made of the alignment of the centres of a long lathe.

In order to bring the image of the collimating mark in the sight into coincidence with a fixed alignment mark, the position of the sight is adjustable.

In this manner, the alignment of the sight with respect to the firing direction can be checked at any desired instant and corrected if necessary, and compensation may be made for mechanical and thermal effects which may cause both the firing direction and the viewing direction of the sight to vary. This is of considerable importance because even a small deviation from the ideal position leads to a large difference between the actual point of impact and the desired point of impact of a projectile which has been fired.

By carrying out the check at various elevations of the firing barrel, it is also possible for the tracking of the viewing direction of the sight and the barrel to be adjusted.

The known systems are quite satisfactory provided visible light is employed. If infrared sights which comprise an infrared camera and a collimating mark formed with infrared light are used, problems arise, however, because it is not readily possible to form an image of an infrared collimating mark sharply in the sight. As a consequence of this, it is also not readily possible to being the blurred image of the collimating mark after conversion to visible form accurately into coincidence with the fixed alignment mark.

There are several reasons for the loss of definition of a collimating mark formed with infrared light, a visible image of which is formed in the sight. A first reason is the fact that infrared light has a relatively large wavelength, as a result of which defraction phenomena are more likely to play a role than in the case of visible light. These defraction phenomena play a greater role, the smaller the optical elements are which are used in the infrared light path. In the case of a field adjustment device, the mirror or collimator placed on the firing barrel should always have small dimensions, in the order of 2 to 3 cm diameter, in order to keep the mass inertia forces encountered on the mirror or collimator during the sometimes violent movements of the firing barrel as small as possible.

A further reason for the loss of definition of a collimating mark formed with infrared light after it has been converted into a visible collimating mark is that this conversion is usually carried out in the infra-red cameras normally used in I.R. aiming systems by scanning the infrared image presented with discrete detectors which scan the image presented in accordance with a predetermined pattern. The width of the image lines of the image which is built up in this manner is not negligible with respect to the lines of the collimating mark.

As a consequence of the two reasons mentioned above, a blurred visible collimating mark is produced which is difficult to bring accurately into coincidence with the fixed alignment mark. The result is that different people usually adjust the sight and the firing direction in different positions with respect to each other, although only one position is correct.

This problem is further intensified if the fixed alignment mark is itself obtained by generating a signal electronically in predetermined positions of the scanning infrared detectors. After all, the fixed alignment mark cannot in that case be any sharper than records with the dimensions of the detectors. In that case, for the alignment, a relatively blurred collimating mark has to be brought accurately into coincidence with a relatively blurred fixed alignment mark, which makes an accurate alignment very difficult.

The object of the invention is to eliminate the drawbacks outlined and to make available an infrared collimating mark which, despite a relatively blurred image after conversion into a visible collimating mark, can nevertheless be brought in a reproducible and reliable manner into coincidence with a fixed alignment mark.

According to the invention for this purpose a collimating mark device providing an infrared collimating mark is characterized in that the collimating mark device is designed in a manner such that the infrared collimating mark comprises at least two essentially V-shaped intensity distributions, the points of the V shapes facing each other and being at such a distance from each other that in the sight they blend with each other.

Attention is drawn to the fact that the collimating mark device according to the invention can be used in all the situations in which an infrared camera has to be aligned or adjusted by means of a collimating mark. As an example, mention may be made of the use of a collimating mark according to the invention in a device for adjusting the tracking in a vertical plane of an (infrared ) slighting device and a swivelable element of the type as described in the Dutch patent application 8,402,659.

The collimating mark according to the invention may, in addition, be used with advantage in a field adjustment device which is suitable for infrared light.

The invention will be explained in more detail below with reference to the accompanying drawing.

FIG. 1 shows diagrammatically the relative positions of the firing barrel of a gun of a combat tank and of the aiming camera of the combat tank;

FIG. 2 illustrates diagrammatically a sharp and a blurred image of a linear collimating mark and the associated intensity distributions;

FIG. 3 illustrates diagrammatically a blurred image of a cross-shaped collimating mark;

FIG. 4 shows diagrammatically a front view of a first exemplary embodiment of a collimating mark according to the invention;

FIG. 5 shows the collimating mark of FIG. 4 in side view;

Figure 13:
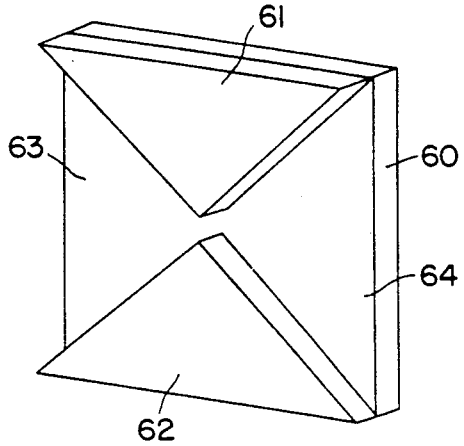
Figure 10:
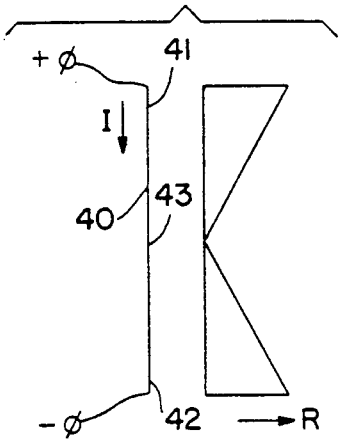
Figure 11:
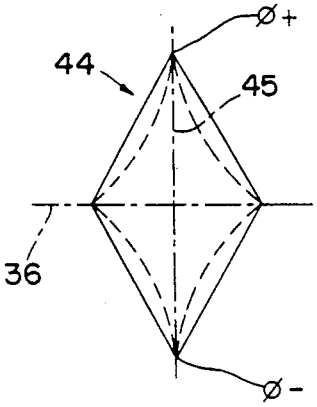
Figure 12:
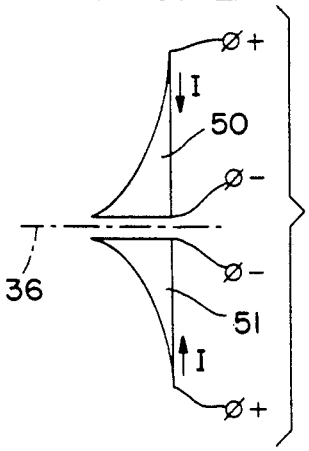

FIGS. 10 to 12 incl. illustrate a few more exemplary embodiments of a collimating mark according to the invention; and FIG. 13 shows yet another exemplary embodiment.

FIG. 1 shows diagrammatically in plan view a turret 1 of a combat tank, not shown in more detail, which is provided with a gun, the firing barrel 2 of which can be seen. In addition, an infrared aiming camera 3 is shown diagrammatically and this extends partially through the turret in the usual manner so that the surroundings can be observed and imaged on a screen situated inside the turret.

In order to be able to aim the firing barrel of the gun accurately, a fixed relationship which is determined as accurately as possible should exist between the position of the aiming camera and that of the firing barrel, or between the viewing direction of the aiming camera and the firing direction. In FIG. 1 the viewing direction is diagrammatically indicated by a centre line 4, while the firing direction is indicated by a centre line 5. Usually the adjustment of the aiming camera is chosen so that both centre lines are parallel, but it is also possible to choose a point at a certain distance where the centre lines intersect each other.

Since the centre lines 4 and 5 are only abstract lines, to determine the viewing direction of the aiming camera use is made of an alignment mark which usually consists of two lines which intersect each other, the intersection point of which indicates the aiming point. As in the case of sights for visible light, the alignment mark can be provided on the screen, for example by etching, drawing or engraving, but it may also be generated electronically as already described above. To bring the viewing direction into coincidence with the firing direction, use is made of a collimating mark which may likewise consist, for example, of two lines which intersect each other and which is projected from the mouth of the firing barrel onto the entrance window of the aiming camera as indicated by an arrow 6. For this purpose, the collimating mark may itself be placed on the mouth of the firing barrel and projected onto the aiming camera via a collimator. Often the collimating mark is also placed on or near the beginning of the firing barrel as indicated at 7 in FIG. 1 and is reflected via a mirror 8 (autocollimator) on the mouth of the firing barrel into the aiming camera. If the alignment mark and the collimating mark then coincide with each other in a predetermined manner on the viewing screen of the aiming camera, for example, in the event that the alignment mark and the collimating mark each consist of two lines which intersect each other, by the intersects of said lines coinciding, the aiming camera is precisely aligned.

After an initial alignment of the aiming camera, the alignment should be repeatedly checked during use because the position of the aiming camera with respect to the firing barrel and, in particular, the mouth of the firing barrel, which determines the firing direction, may vary during operation as a result of mechanical and thermal effects.

The alignment technique described above, usually referred to by the term "field adjustment" is per se already used with good result for aiming systems operating with visible light.

As already pointed out, this known technique cannot readily be used with equally good results if an infrared aiming camera is used. This is a consequence of the greater wavelength of infrared light, as a result of which the sharpness of the image is more likely to be affected by defraction phenomena, and in addition, of the fact that, in the aiming camera, the infrared image received has to be converted into a visible image. This last operation is usually performed by scanning in accordance with a raster pattern by means of discrete infrared detectors which, as it were, sample the image presented, as a result of which additional loss of definition (sampling noise) is introduced.

All this is invention in more detail in FIGS. 2 and 3.

FIG. 2*a* shows a line 10, drawn thickly for the sake of clarity, which may, for example, be a line of a collimating mark. FIG. 2*b* shows the associated light intensity distribution along the line 11 in FIG. 2*a*, it being assumed that the line 10 is lighter than the surroundings.

FIG. 2*c* shows the image 10′ of the line 10 as it is rendered visible on the viewing screen of the infrared camera, while FIG. 2*d* again shows the associated intensity distribution. It is clear that the image 10′ is less sharp than the image 10 presented.

FIG. 3*a* shows two lines 12, 13 which intersect each other and FIG. 3*b* shows the associated images 12′ and 13′ on the viewing screen of the infrared camera. From the image shown in FIG. 3*b*, the exact position at which the intersect of the lens 12 and 13 is situated can no longer be accurately inferred, whereas, if lines which intersect each other are used as collimating mark, the position of the intersect, in particular, is of considerable importance for an accurate adjustment of the aiming camera.

As a result of the phenomena described above and illustrated in FIGS. 2 and 3, it is not readily possible to adjust the aiming camera accurately if an infrared aiming camera is used, at least, not by means of the same techniques as are used in the case of aiming systems designed for visible light.

From investigations and experiments by the Applicant it has emerged, however, that the disadvantageous effects of a blurred image of an infrared collimating mark on the viewing screen of an infrared aiming camera may essentially be eliminated if the infrared collimating mark is presented in the form of a special spatial intensity distribution.

FIG. 4 shows a front view of a first embodiment of a collimating mark device according to the invention, as well as the intensity distribution obtained therewith, and FIG. 5 shows the collimating mark device of FIG. 4 in side view. The collimating mark device depicted comprises a plate 15 which is in this case rectangular and which is heated during operation to provide an image which can be observed with an infrared camera. The plate 15 can be heated by passing an electric current through the plate, which should then be manufactured from conducting material, or, as depicted in FIG. 5, by heating the plate by means of a more or less diagrammatically indicated source of heat 16 which may be placed, for example, in a house 17 which also serves as mounting for the plate.

Two approximately triangular flat shielding elements 18, 19 are placed essentially parallel to the plate 15 at some distance from the plate 15 on the side of the plate 15 facing the aiming camera during operation. The bases of two triangular elements are situated level with the two opposite sides of the plate 15, while the angles or points 20, 21, situated opposite the bases, of the shielding elements face each other and are situated near the centre of the plate, but lie at low distance from each other. Two intensity distributions along the lines p-q and r-s which are produced if the plate 15 is heated are shown on the right in FIG. 4.

It has emerged that, although the intensity distributions do not contain sharp junctions, the human eye nevertheless constructs two sharp lines with a well defined intersect, and does so in a reproducible manner, from the two-dimensional intensity distribution thus obtained which does not contain any sharp lines or points even after conversion into visible light on the viewing screen of the infrared aiming camera of the sight.

These lines observed by the human eye are indicated in FIG. 4 by 23 and 24, while the intersect is indicated by 25. The lines observed by the human eye run parallel to the sides of the triangular shielding elements at some distance therefrom, and the intersect is situated between the two points 20, 21 of the triangular shielding elements. This intersect can therefore be brought in a sufficiently accurate manner into coincidence with the fixed alignment mark in order to adjust the aiming camera.

The sharpness of the lines 23, 24 and, in particular of the intersect 25 can be adjusted by making the distance between the points 20, 21 of the triangular elements adjustable. For this purpose, the triangular elements may be mounted so as to slide, as indicated by arrows 26, 27, in the collimating mark device.

The sharpness of the intersect 25 may, in addition, be adjusted by means of the brightness and contrast control system of the infrared camera.

Attention is drawn to the fact that the sides which interact at the points of the triangular elements do not necessarily have to be straight but could also be somewhat curved. It is only important that two approximately V-shaped intensity distributions are obtained which, with a correct adjustment, blend with each other in a manner such that the human eye observes two lines, optionally curved, which intersect each other and have a sharp intersect.

Figure 6:
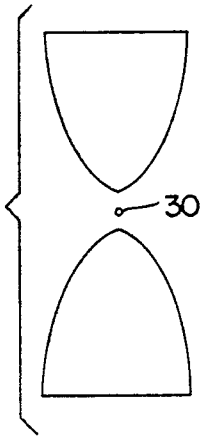
FIG. 6, FIG. 7, FIG. 8 and FIG. 9 show, diagrammatically, modified exemplary embodiments of a collimating mark according to the invention.
Figure 7:
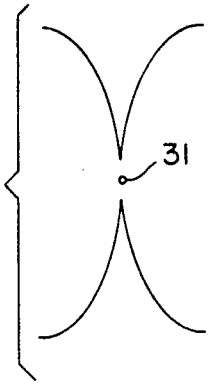

FIGS. 6 and 7 show alternative embodiments of the triangular elements having convex and concave sides respectively. The intersects and indicated by 30 and 31 respectively.

The apex angles of the triangular elements are preferably 90°, but other values are possible. If desired, the size of the apex angle can be matched to the resolution of the infraction camera if, for example, the horizontal resolution is not equal to the vertical resolution.

It is also not strictly necessary for the triangular elements to be symmetrical with respect to a perpendicular dropped from the apex angle to the base, that is to say, in the case of FIG. 4, that the triangular elements are not isoceles, but a symmetrical shape is preferred.

Figure 8:
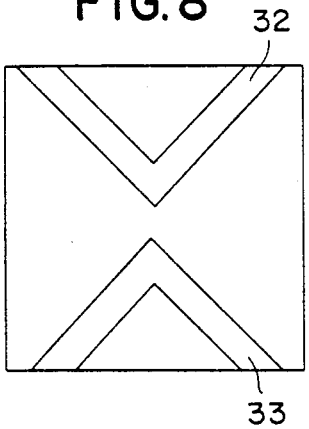

Another possible embodiment is shown in FIG. 8. In this embodiment, the triangular elements are constructed as wide V-shaped plates 32 and 33. This embodiment can also be used in principle but, as the result of the lack of shielding material at the bases of the elements, it results in an image which is less pleasant to observe.

Figure 9:
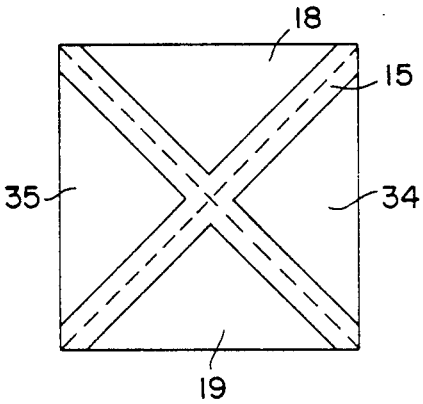

In addition, it is possible to use, instead of two triangular elements, four such elements as shown in FIG. 9 in which two additional elements 34 and 35 are shown so that only two strips along the diagonals of the plate 15 are not covered. This embodiment, however, offers virtually no improvement with respect to the embodiment having two triangular elements but requires, on the other hand, a very accurate adjustment of the two additional elements 34, 35 with respect to the other two elements 18, 19. An embodiment having two covering elements is therefore preferred.

It is pointed out that, in the foregoing, the assumption has always been made of a heated plate 15 which is partially shielded by cooler covering elements. The desired effect can, however, also be obtained by heating just the triangular elements. The plate 15 then remains cooler, optionally by providing special cooling means for the plate 15, so that two essential V-shaped intensity distributions are again obtained. The plate 15 could in that case in principle even be omitted entirely.

The essentially triangular elements, optionally having curved sides, may be manufactured in a suitable manner from thin metal sheet, for example a thin steel sheet. In a test arrangement, triangular platelets cut from scissors were used successfully.

As indicated in the foregoing, it is essential for the invention that such a two-dimensional intensity distribution is generated that the human eye can construct therefrom two sharp lines which intersect each other and have a sharp intersect, after conversion into a visible image. According to the exemplary embodiment described in the foregoing, for this purpose, at least two essentially triangular elements are used which have their points facing each other and which extend in a plane which is essentially transverse to the direction of observation, that is to say transverse to the imaginary connecting line indicated by 36 in FIG. 5 between the centre of the collimating mark and the centre of the entrance window of the aiming camera or of the mirror or collimator on the barrel.

In this manner, the desired two-dimensional intensity distribution extending in the same plane is automatically obtained. It is, however, also possible to generate a suitable two-dimensional intensity distribution extending in a transverse plane situated transversely to the connecting line 36 by means of elements which are not situated in the transverse plane.

For this purpose, use may, for example, be made of an electrical conductor which passes an electric current during operation and which lies essentially in a plane containing the connecting line 36 and intersects the connecting line essentially perpendicularly. In order to obtain an X-shaped intensity distribution in this manner, the conductor should have a coldest point from which the temperature increases towards both ends. This can be achieved by constructing the conductor in a manner such that the resistance thereof is highest at the ends and decreases gradually to a minimum value in the direction of a point situated between the two ends.

The principle is shown in FIG. 10. A conductor 40 passes an electric current I during operation. The variation in resistance of the conductor over the length thereof is indicated next to the conductor. The resistance R is highest at the ends 41, 42 of the conductor and lowest in the centre of the conductor at point 43. The amount of heat generated in the conductor therefore decreases from the ends 41, 42 towards the point 43 so that, as a consequence of the small numerical aperture of the infrared optics used, the conductor produces an hour glass-shaped spatial heat distribution which provides a similar intensity distribution in a plane through the conductor as was obtained in the embodiments described above.

Such a conductor may be formed by means of a flat metal plate which is cut out in a manner such that the cross-sectional area thereof is small at the ends and is large in the central region. An example is shown in FIG. 11.

FIG. 11 shows a plate-type conductor 44 having a diamond shape which lies in a plane containing the connecting line 36. One of the diagonals (45) extends transversely to the line 36, and the other diagonal coincides with the line 36. An electrical energy source is connected between the ends of the diagonal 45. The plate-type conductor may also have curved sides such as are shown by the broken lines in FIG. 11.

In addition, the plate could be constructed not only more widely, but also, at least in part, more thickly in the vicinity of the line 36 than at the ends.

As an alternative, two separate conductors of approximately triangular shape, which leave the region in the vicinity of the line 36 free, may be used. Such an embodiment is shown in FIG. 12. FIG. 12 shows a first approximately triangular conductor 50 which passes a current I during operation and a second matching conductor 51 which likewise passes a current I during operation. Both conductors lie in one and the same plane which also contains the connecting line 36 and are placed symmetrically with respect to the connecting line 36, a gap being present between the two conductors.

In FIG. 12, one of the sides of the two conductors is curved. The other sides could likewise be of curved construction. The edges of the two conductors which face the other conductor may also include a mutual angle, as can the edges drawn in line with each other in FIG. 12. In addition, the conductors may again be thicker at the level of the ends facing each other than in the vicinity of the apex angles situated opposite.

FIG. 13 shows a simple embodiment in which no external heat source is necessary.

On a plate 60 of a first material, a pattern of two triangles 61 and 62 is provided with a second material. The materials are chosen in such a manner that they have different visibility in the infrared. The difference in visibility is obtained, for example, by manufacturing the plate 60 from germanium on which the triangles 61 and 62 are provided in a manner known per se as reflective coatings of alternating layers of ZnS and Ge so that a reflection of approximately 97% is achieved in the infrared region concerned. In the same manner known per se, the remaining triangles 63 and 64 are provided with an antireflection coating of alternating layers of ZnS and Ge so that a transmission of approximately 98% is achieved. As a result of the difference in visibility in the infrared, the pattern is visible without there being any question of a difference in temperature between the two materials.

This embodiment has particular advantages in those cases in which an external heat source is undesirable or impossible.

By way of example, it may be mentioned that an infrared detector contains a number of detector elements on a carrier. The dimensions on the carrier are approximately 10 mm diam. On the carrier connecting points are provided to the outside. Each connecting point is connected to one or more detector elements. Such a detector can be used in an infrared detection system in order to cause, by means of autocollimation, the viewing direction of the infrared sight to coincide with the firing direction of a gun as already described above. The viewing screen on the aiming camera then shows the mirror image on the detector on which the detector elements and connecting points are visible. The viewing and firing directions coincide if one specific point of the image of the detector shown coincides with a specific point of the alignment mark. However, such detectors consist, in general, of a matrix of identical, indistinguishable elements. Which part of the detector is visible cannot be inferred from the image of the detector when adjusting the viewing direction and/or the firing direction. Although another part of the detector will become visible as a result of displacement, the observer of the image on the viewing screen is not capable of distinguishing the new image from the old image. In this situation it is particularly advantageous if a single marking symbol is provided on the detector which has to be brought precisely into coincidence with a specific point of the alignment mark. For this purpose, for example, a collimating mark is provided on the carrier of the detector as described above and consists of a pattern of two triangles vapour-deposited using gold and having dimensions in the order of 0.1 mm. As a result of the difference in emission coefficient of gold and carrier, the pattern will be visible for the infrared detection system despite the fact that no temperature difference is present.

Attention is drawn to the fact that, after the foregoing, various modifications of the embodiments described are obvious to those skilled in the art. Thus, in the configuration of FIG. 10, use could also be made of two conductors which cross each other but are identical in other respects. In an analogous manner, two diamond-shaped conductors as shown in FIG. 11 could be used which are placed behind each other in planes which intersect each other perpendicularly. Equally, four triangular conductors as shown in FIG. 12 may be used. Such modifications are considered to fall within the scope of the invention.

I claim:

1. A collimating mark device for use with a sight comprising means for forming an infrared collimating mark having two essentially V-shaped intensity distributions with points of said V-shaped intensity distributions directed to each other.

2. The collimating mark device as defined in claim 1 wherein said means for forming said infrared collimating mark is comprised of two essentially triangular-shaped plate elements each having an apex angle facing each other lying in a plane extending transversely to an optical connecting line between said sight and said collimating mark device.

3. The collimating mark device as defined in claim 2 wherein said triangularly-shaped plate elements are disposed in front of a heating plate.

4. The collimating mark device as defined in claim 3 wherein said triangularly-shaped plate elements are spaced apart from each other.

5. The collimating mark device as defined in claim 4 wherein said triangularly-shaped plate elements are provided with heating elements.

6. The collimating mark device as defined in claim 2 wherein said triangularly-shaped plate elements are formed with sides curved towards said apex angle.

7. The collimating mark device as defined in claim 2 wherein said triangularly-shaped plate elements are formed with a cut-out portion in a side opposite said apex angle.

8. The collimating mark device as defined in claim 1 wherein said means for forming said infrared collimating mark is comprised of four essentially triangularly-shaped plate elements each having an apex angle facing an opposite plate element.

9. The collimating mark device as defined in claim 1 wherein said means for forming said collimating mark comprises an electrical conductor extending essentially transversely to an optical connecting line between said sight and said collimating mark device in a plane of said optical connecting line, resistance of said electrical conductor decreasing from ends thereof.

10. The collimating mark device as defined in claim 9 wherein said electrical conductor is diamond-shaped having a first diagonal parallel to said optical connecting line and a second diagonal transverse thereto, electrical connection to said electrical conductor being provided at ends of said second diagonal.

11. The collimating mark device as defined in claim 10 wherein said diagonals are curved.

12. The collimating mark device as defined in claim 10 and further including a second diamond-shaped electrical conductor in a plane perpendicular to said electrical conductor and having a first diagonal in line with said first diagonal of said electrical conductor.

13. The collimating mark device as defined in claim 9 wherein said electrical conductor is comprised of two spaced apart in line electrical conductor portions each of which conductor portions being of an increasing resistance towards ends proximate one another.

14. The collimating mark device as defined in claim 13 wherein said electrical conductor portions are essentially triangular-shaped.

15. The collimating mark device as defined in claim 14 wherein sides of said electrical conductor are curved.

16. The collimating mark device as defined in claim 13 wherein one electrical conductor portion is positioned essentially perpendicular to a plane intersecting a plane of the other electrical conductor portion and a line of intersection of said electrical conductor portion being parallel to said optical connecting line.

17. The collimating mark device as defined in claim 10 wherein said diamond-shaped electrical conductor is thicker at said first diagonal then at said ends of electrical connection.

18. The collimating mark device as defined in claim 2 wherein said triangularly-shaped plate elements are provided with a surface reflecting infrared radiation and mounted to a carrier member provided with a surface absorbent to infrared radiation.

19. The collimating mark device as defined in claim 18 wherein said carrier member is formed of germanium.

20. The collimating mark device as defined in claim 18 wherein said reflecting infrared radiation surface is formed by vapor deposition of gold.

21. An adjustment assembly for aligning a line of direction of an infrared sight and firing direction of a gun, which comprises a collimating mark device comprising means for forming an infrared collimating mark having two essentially V-shaped intensity distributions with points of said V-shaped intensity distributions directed to each other, said collimating mark representing the firing direction of said gun, means for imaging said collimating mark in visible form in a sight means for adjusting said sight to coincidence said visible image with a fixed alignment mark in said sight.

* * * * *